US007216889B2

(12) United States Patent
Haupt

(10) Patent No.: US 7,216,889 B2
(45) Date of Patent: May 15, 2007

(54) BINDINGS FOR SKI BOOTS FOR SNOWBOARDS

(75) Inventor: Olivier Haupt, Grenoble (FR)

(73) Assignee: Skis Rossignol SA, Voiron (FR)

( * ) Notice: Subject to any disclaimer, the term of this patent is extended or adjusted under 35 U.S.C. 154(b) by 0 days.

(21) Appl. No.: 10/138,865

(22) Filed: May 3, 2002

(65) Prior Publication Data

US 2002/0163162 A1 Nov. 7, 2002

(30) Foreign Application Priority Data

May 4, 2001 (FR) ..... 01 06109

(51) Int. Cl.
*A63C 9/18* (2006.01)

(52) U.S. Cl. ..... 280/618; 280/14.24; 280/14.22; 280/11.26

(58) Field of Classification Search ..... 280/618, 280/633, 634, 809, 14.21, 14.22, 14.24, 607, 280/11.16, 613, 617, 626
See application file for complete search history.

(56) References Cited

U.S. PATENT DOCUMENTS 4,177,584 A * 12/1979 Beyl ..... 280/613
4,336,654 A * 6/1982 Svoboda et al. ..... 33/3 A
4,772,041 A * 9/1988 Klosterman ..... 280/611
4,836,571 A * 6/1989 Corbisiero ..... 280/600
4,871,186 A * 10/1989 Klosterman ..... 280/611
5,503,900 A * 4/1996 Fletcher ..... 428/160
5,586,779 A * 12/1996 Dawes et al. ..... 280/14.24
5,758,895 A * 6/1998 Bumgarner ..... 280/607
5,836,592 A * 11/1998 Chang ..... 280/11.26
5,909,886 A * 6/1999 Tugutaka et al. ..... 280/14.21
5,970,632 A * 10/1999 Watson ..... 36/122
5,971,407 A * 10/1999 Zemke et al. ..... 280/14.22
5,992,861 A * 11/1999 Piotrowski ..... 280/7.14
6,105,992 A * 8/2000 Schaller et al. ..... 280/613
6,113,114 A * 9/2000 Zemke et al. ..... 280/14.26
6,145,868 A * 11/2000 Schaller et al. ..... 280/624
6,189,911 B1 * 2/2001 Caron et al. ..... 280/607
6,217,039 B1 * 4/2001 Iverson et al. ..... 280/11.26
6,315,305 B1 * 11/2001 Gien ..... 280/14.24
6,328,328 B1 * 12/2001 Finiel ..... 280/636
6,394,484 B1 * 5/2002 Maravetz et al. ..... 280/624

FOREIGN PATENT DOCUMENTS

EP 1 053 769 11/2000
FR 2 769 236 * 10/1997 ..... 280/14.24
WO WO 98/42419 10/1998

* cited by examiner

*Primary Examiner*—Christopher P. Ellis
*Assistant Examiner*—Bridget Avery
(74) *Attorney, Agent, or Firm*—Fay Sharpe LLP

(57) ABSTRACT

A binding (2) which retains a boot (11) on a snowboard (1) includes a base member (4). Rear walls (8*a*, 8*b*) and a rear arch (9) with a rear portion (21) of the base member support a heel of the boot. A front support piece (18) to which a toe strap (16) is pivotally mounted (24*a*, 24*b*), is adjustably mounted to a front part (20) of the base member. The front support piece is longitudinally adjustable and a length of the toe strap is adjustable to enable the binding to receive boots of different length and style.

17 Claims, 7 Drawing Sheets

BINDINGS FOR SKI BOOTS FOR SNOWBOARDS

BACKGROUND OF THE INVENTION

The present invention concerns ski bindings, particularly bindings for snowboards.

For the practice of snowboarding, the skier uses ski boots with relatively supple or flexible bindings. Known bindings include a base plate and a back piece for receiving the boot. Moreover, the boots are supported by bindings. The sole of the boot is received directly on the base plate, as is shown, for example, in U.S. application Ser. No. 09/972,455, filed Oct. 5, 2001, or only on the front piece such as is described in European Patent No. EP1 053 769 A1. Of course, all boots are not the same length due to being different sizes, as well as due to being boots of different types and brands. Besides, the manufacturer's define their own shapes for the front of the boot. Previously, the position of the support and binding straps are not particularly adapted to the boot of the user. Consequently, this results in poor retention for certain boots which do not have the dimension or the optimal shape for the front support.

SUMMARY OF THE INVENTION

The present invention resides in an improvement that permits a skier to have a front support ideal for his style of skiing and the chosen type of boot. It also permits optimal adjustment on the favorite mounting for snow and hill conditions so that one skis under excellent circumstances.

In accordance with another aspect of the present invention, the binding is more of a type which supports and carries the boot and less of a means of retaining the front of the boot. The lower piece comprises a mechanical supporting piece in front of the toe of the boot. The front support piece and the front retaining means together form a front support and a retaining assembly. The front support piece is mounted by a movable retainer on the base plate which enables its longitudinal position to be adjusted with respect to the base plate.

According to a complimentary characteristic, the combination mechanical support and retainer is disposed in a longitudinal channel which extends toward the front and toward the rear on the front part of the base plate.

According to another characteristic, the front retaining means includes a semi-rigid strap which forms an adjustment means.

Additionally, the front support piece has the form of a transverse plate whose side edges are extended by two lateral or side front walls that extend upward. Each of the front side walls is intended to retain the front of the boot laterally and fix the ends of the front retaining means.

According to another characteristic, the ends of the front strap are pivotally mounted on the side front walls to pivot around a transverse front axis defined by two front lateral pivots. A support zone corresponds to a support surface of the front support piece and is disposed in front of a transverse vertical front plane passing through the pivot axis of the front retaining means.

In a preferred embodiment, the support surface of the front support piece is disposed under the horizontal plane that passes through the pivot axis of the front retaining means.

Moreover, the lower base also carries a rear retaining means that retains the boot at the level of the heel of the foot.

The front and rear retaining means are preferably a flexible strap made of plastic material.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
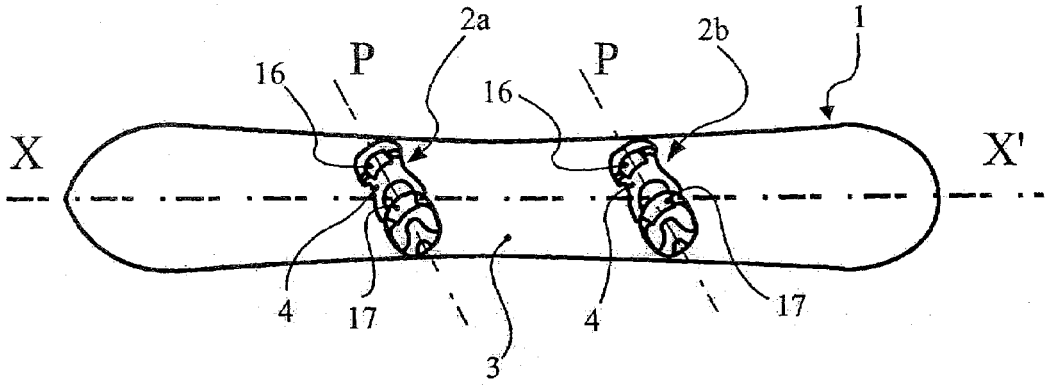
FIG. 1 is a top view of a snowboard provided with two bindings for the user's boots.

With reference to FIG. 1, a snowboard 1 is provided with two mountings 2*a*, 2*b* for retaining the boots of the user. The two bindings are mounted on the upper surface 3 of the snowboard 1 such that their general plane of symmetry P is at an angle relative to an axis XX' of the snowboard.

Hereinafter in this application, each of the bindings 2*a*, 2*b* will be designated by the general reference numeral 2, and it is to be understood that the description applies to both bindings.

Figure 2:
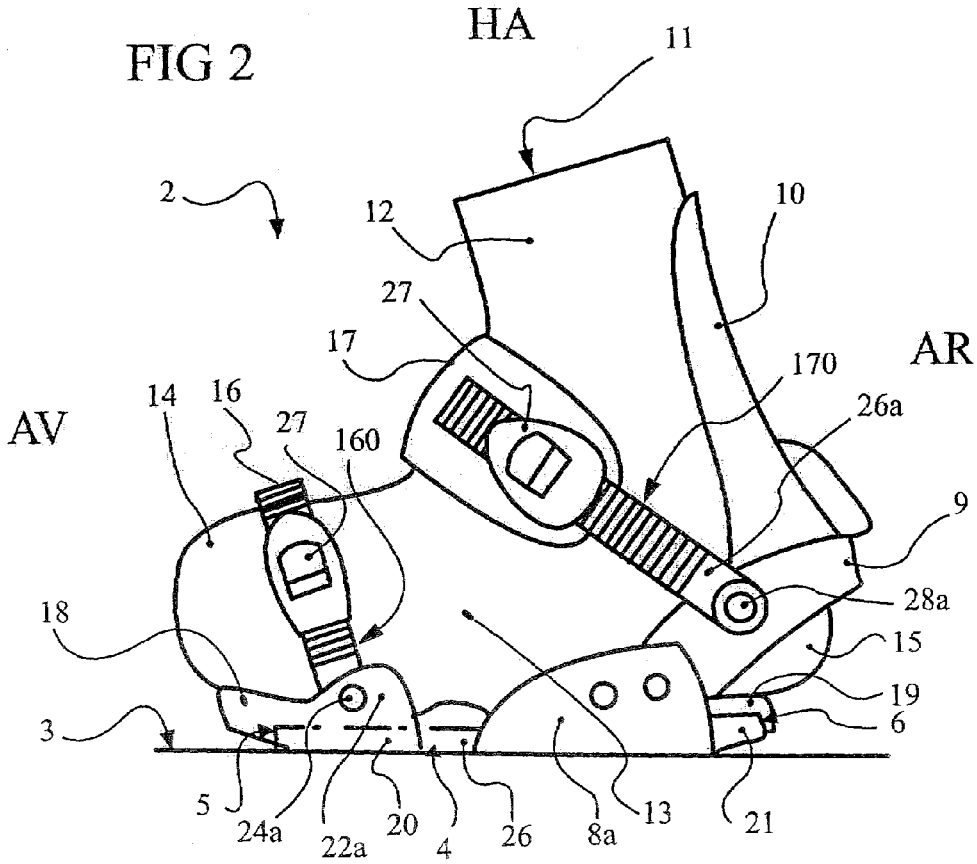
FIG. 2 is a lateral side view of a binding in accordance with the present invention in combination with a boot.
Figure 3:
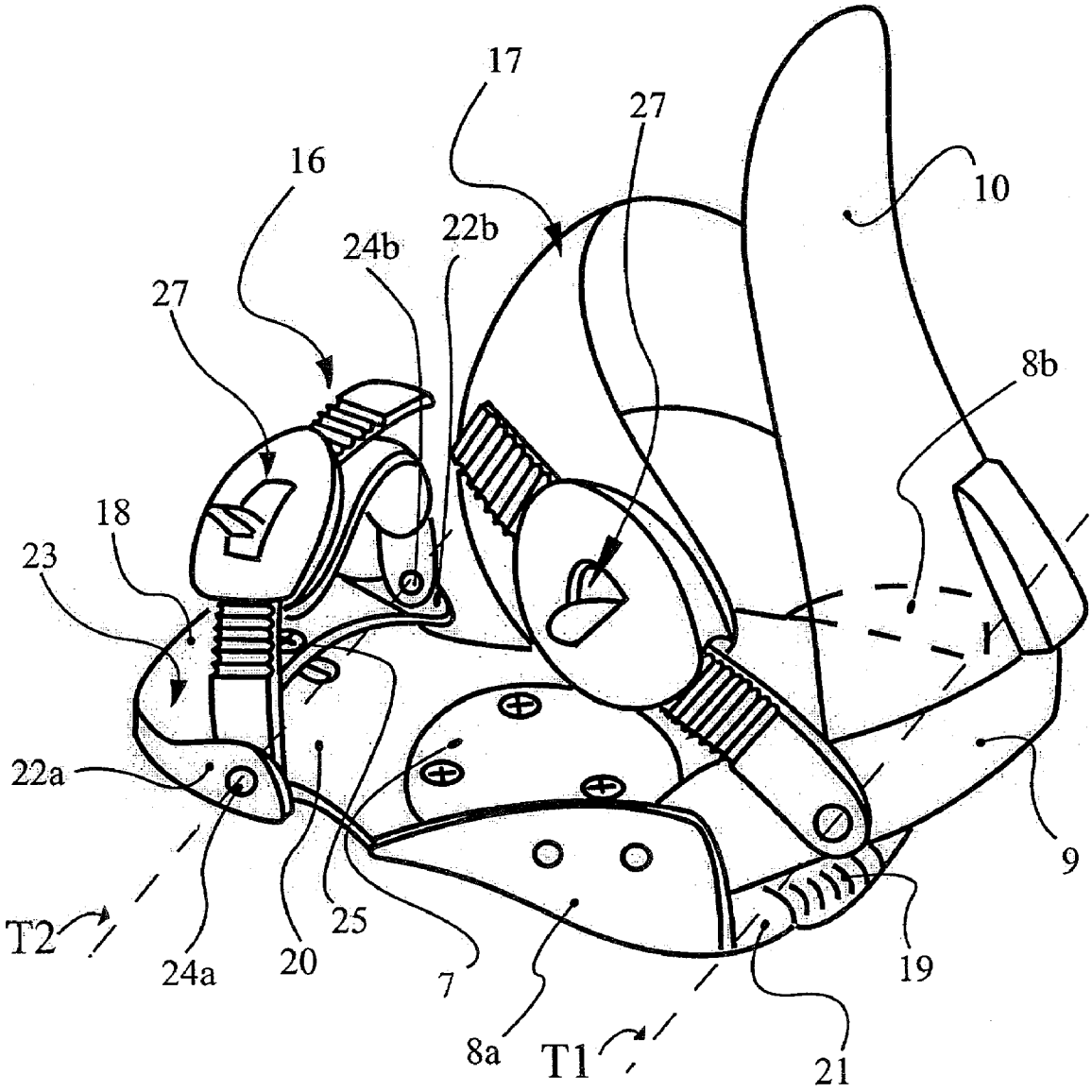
FIG. 3 is a rear perspective view of the binding without the boot.
Figure 4:
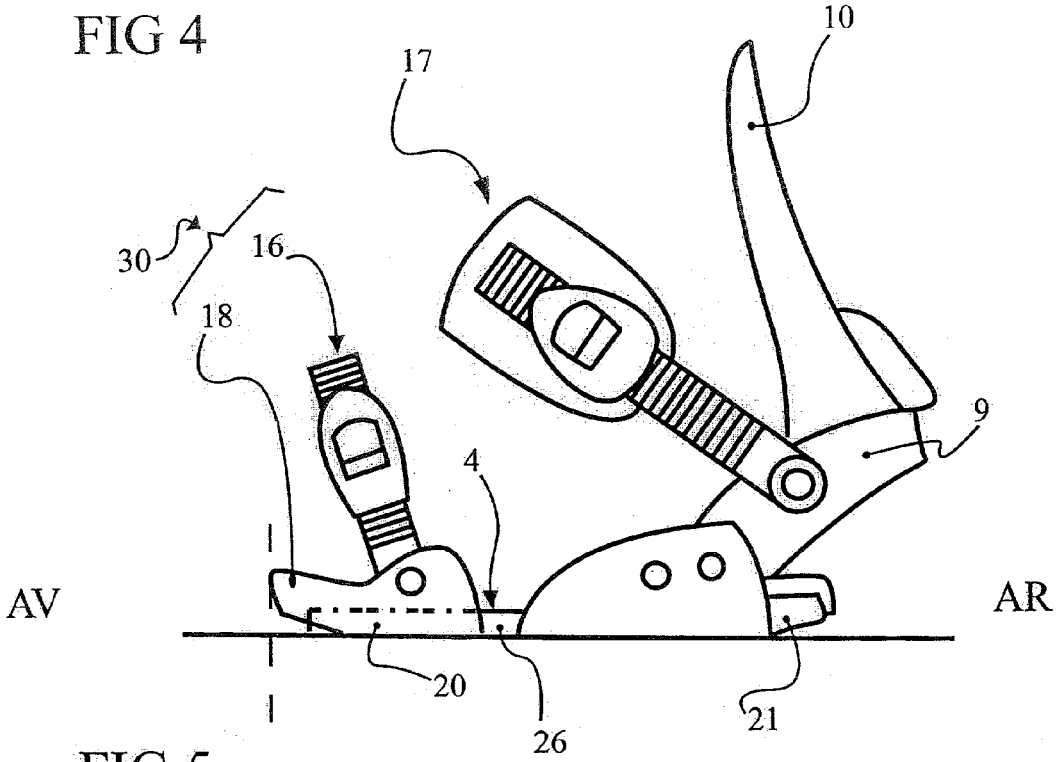
FIGS. 4 and 5 are side views of the binding with the front retainer and support assembly in two different positions of adjustment in length.
Figure 5:
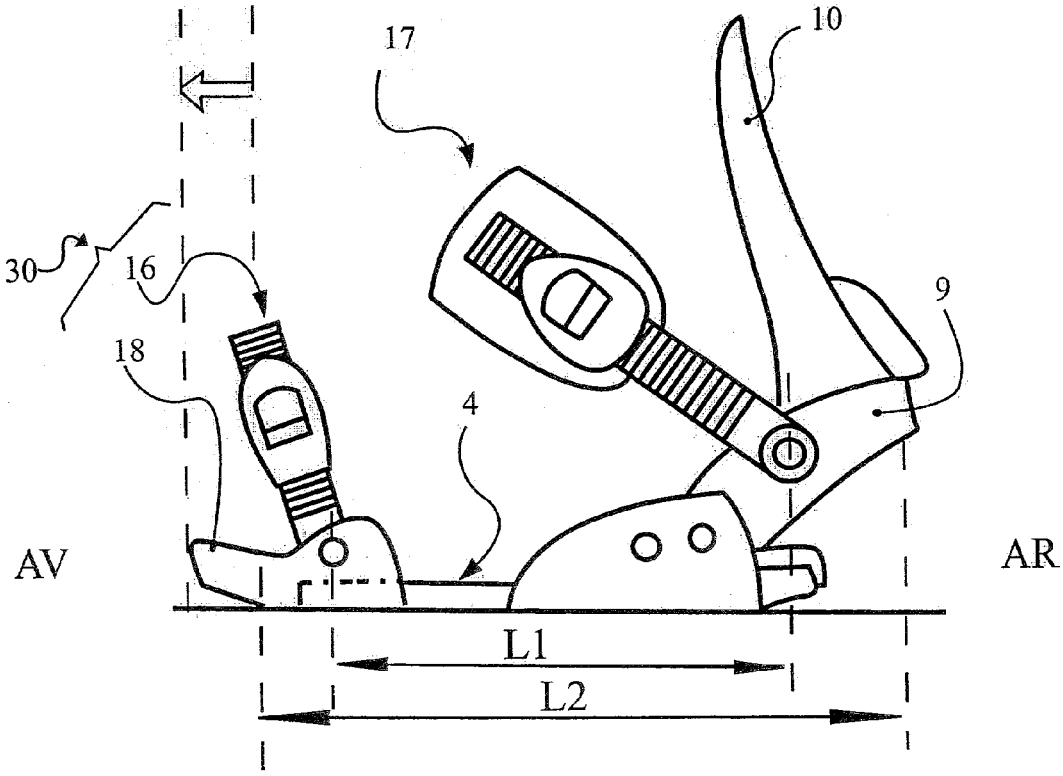
Figure 6:
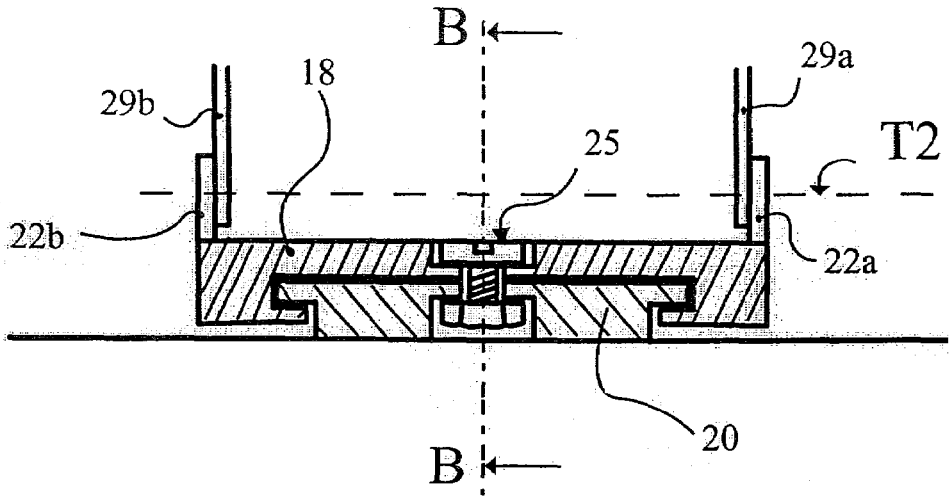
FIG. 6 is a transverse sectional view taken along section A—A at the middle of the stop of the front support.

FIG. 2 is a side view which shows a binding 2 in accordance with the invention that has a base piece or plate 4 that is supported horizontally from a front end 5 to a rear end 6 and is defined by a front part 20 and a rear part 21. The lower base is mounted and fixed on the snowboard in a conventional fashion, for example, by a central piece 7 disposed in a central part 26 of the lower base 4. This central piece is advantageously circular and is in the form of a disk to permit the user to continuously adjust an angular orientation of the base piece with respect to the longitudinal plane of symmetry X,X' of the snowboard.

The rear part 21 of the lower base piece 4 is bordered laterally of each edge by a left lateral or side edge 8*a* and a right lateral or side edge 8*b*. Each of the side edges includes a wall oriented vertically which is designed to limit lateral or sideways movement of the boot.

The two rear lateral edges 8*a*, 8*b* are connected at the rear with a rear arch 9 which carries a rear support piece 10 extending upward toward the top HA. The rear arch 9 serves as stop at the back for a boot 11.

The user's boot 11 has a cuff 12 which is relatively flexible as compared to its lower shell or base part 13 which extends to a toe or front end 14 and a heel or rear end 15 which is mechanically supported near the rear AR against the rear arch 9. The rear support piece 10 serves as a mechanical ankle support at the back for the cuff 10 of the boot 11.

The boot 11, in the illustrated embodiment, is retained on the base piece 4 by a front retaining means 16 which holds the toe 14 of the boot and by a rear retaining means 17 which holds the boot at the level of the heel of the foot.

The front retaining means 16 and the rear retaining means 17 are, in the illustrated embodiment, in the form of a semi-rigid or flexible strap 160, 170, respectively. The straps, for example, are made of a plastic material and advantageously have an adjustment means 27 for adapting to the dimension and size of the boot. Of course, other means for retaining the boot, other than semi-rigid straps, are contemplated.

The ends 26*a*, 26*b* of the rear retaining means 17 are pivotally mounted on the arch 9 about a transverse rear axis T1, preferably by pivotal strap connections 28*a*, 28*b*.

The boot is supported on the base 4 by means of two support pieces, a front support piece 18 for the front end 14 of the boot, and a heel support piece 19 for the rear end 15.

The front retaining means 16 is connected to the front support piece for them to move together and relative to each other. For this reason, the front support piece 18 has the form of a transverse plate whose side edges are extended by two front lateral or side walls 22*a*, 22*b* which extend upward.

Each of the front side walls 22*a*, 22*b* laterally retains the front 14 of the boot. The ends 29*a*, 29*b* of the front retaining means 16 are attached to the front side walls. The ends 29*a*, 29*b* of the front strap 160 are pivotally mounted on these front side walls about a front transverse axis T2 defined by two front side pivots 24*a*, 24*b*.

Consequently, the front support piece and the front strap 16 form a front support and retaining assembly 30 which is movable on the base 4 to provide for positional adjustment relative to the base.

The user can choose the longitudinal position of the front support and retaining assembly 30 and thus of the front support piece 18 with the front retaining means 16 to a chosen position corresponding to the size of the boot and particularly of its front end.

The front support piece 18 includes a stop means which permits the user to fix the movable front assembly 30 in a chosen position. The stop means can be of any kind, for example, a central pin or bolt 25.

The support zone Z (FIG. 7) corresponding to the support surface 23 of the front support 18 is disposed in front of a transverse front vertical plane P2 passing through the pivot axis T2, that is in the space E in front of the plane P2. It is preferable for the support not to be in a zone V situated to the rear of this plane. Preferably, the front support surface 23 is inclined to extend toward the front and toward the top, and is disposed under the horizontal plane H2 which passes through the pivot axis T2.

Because of the independence of the front support and retaining assembly 30 from the rear retaining means 9, 10, 17, 19, a distance L1 between the front retaining means 16 and the rear retaining means is adjustable along with a distance L2 between the front support 18 and the rear arch 9.

Figure 7:
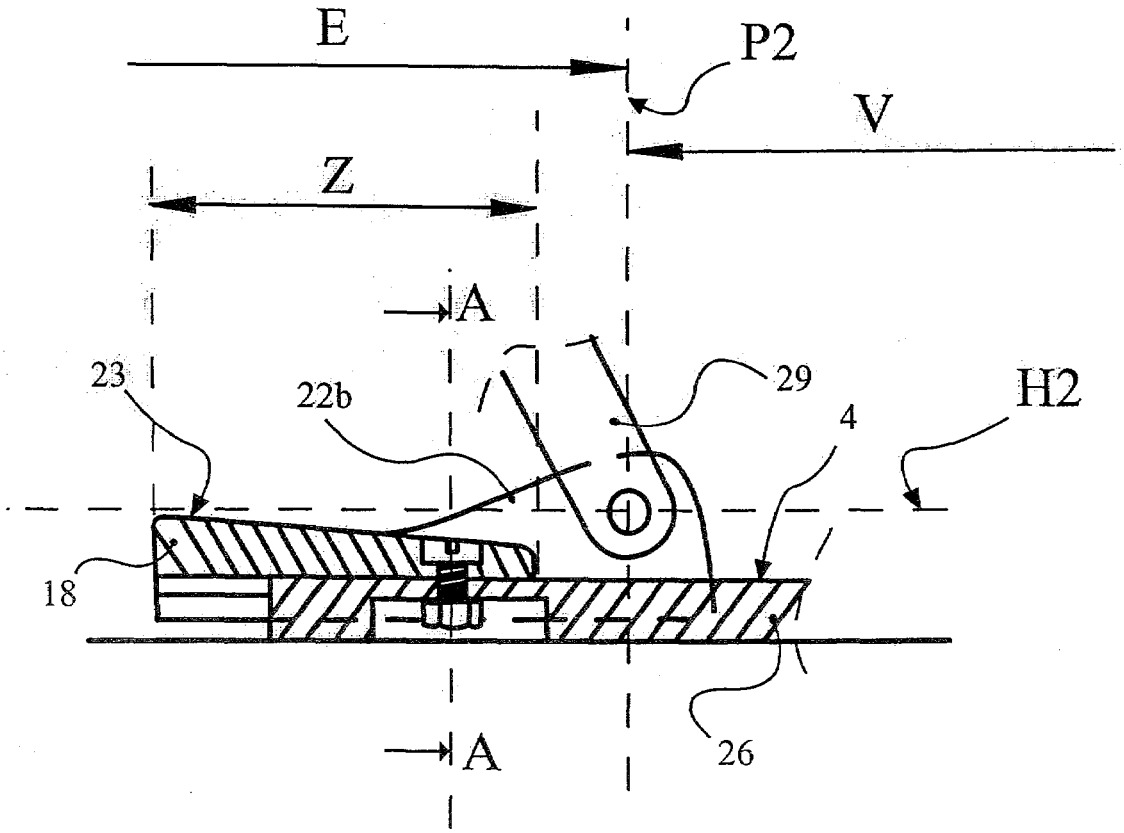
FIG. 7 is a partial, longitudinal section view taken along section B—B at the level of the front support.
Figure 8:
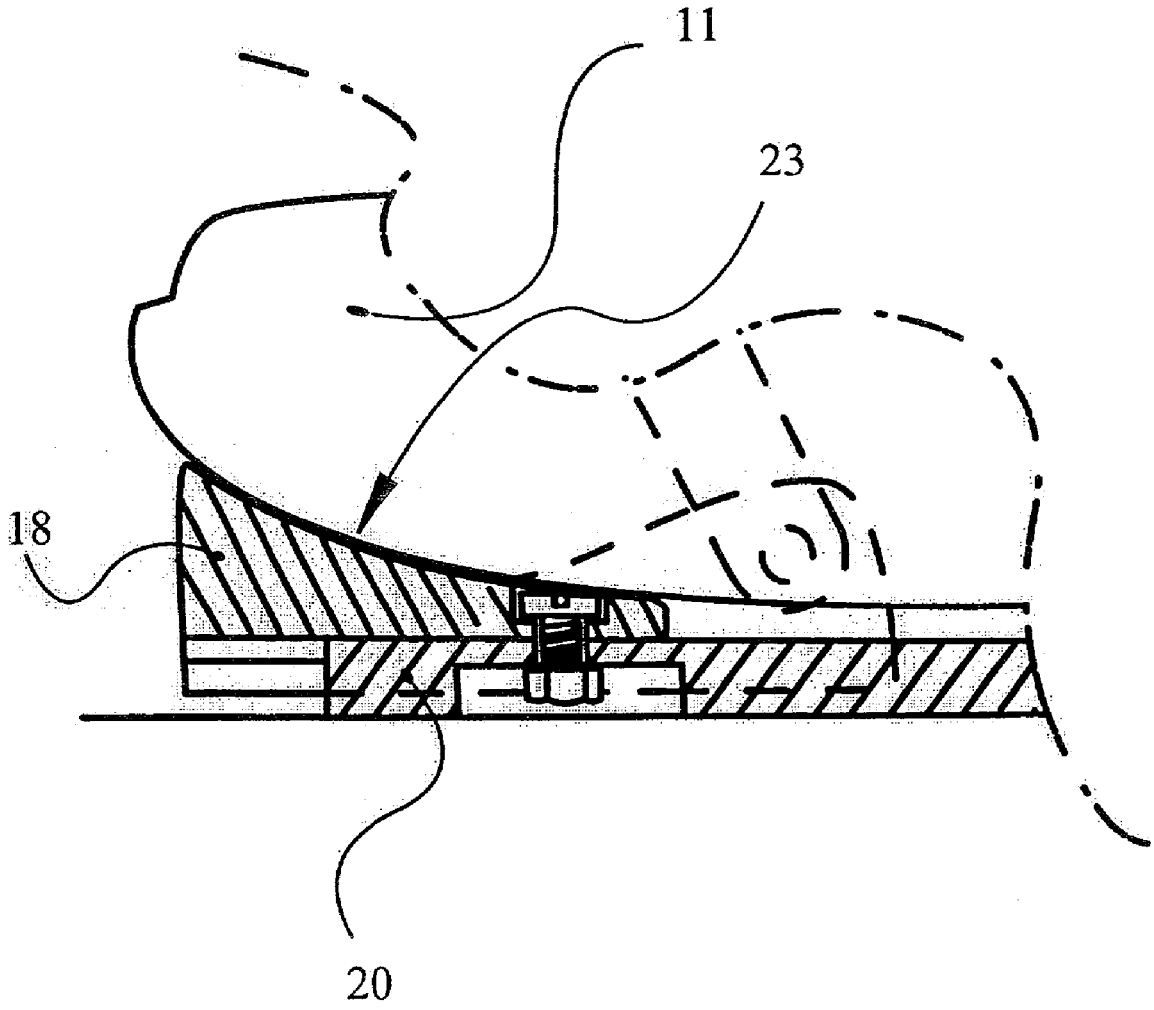
FIGS. 8, 9, 10, and 11 are partial longitudinal section views through section B—B like FIG. 7, but illustrating four different embodiments; and, FIG. 12 is a partial side sectional view of the front mechanical support illustrating another aspect.

The support surface 23 of the support piece 18 may be flat, such as illustrated in FIG. 7; but, it can also have other shapes. FIG. 8 illustrates another embodiment in which the support surface 23 has a contour which conforms with the shape of the front end 14 of the sole of the boot 11 in this support zone.

Figure 9:
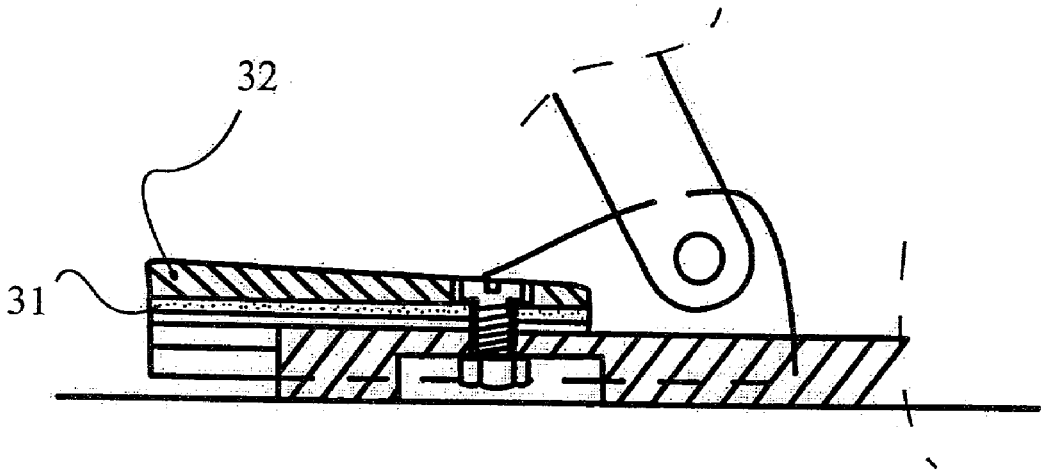

FIG. 9 illustrates another embodiment in which the front support includes an intermediate layer 31 of a deformable or compressible, resilient material, preferably a plastic material such as polyeurethane or the like, disposed under an upper layer 32 which is of a rigid material.

Figure 10:
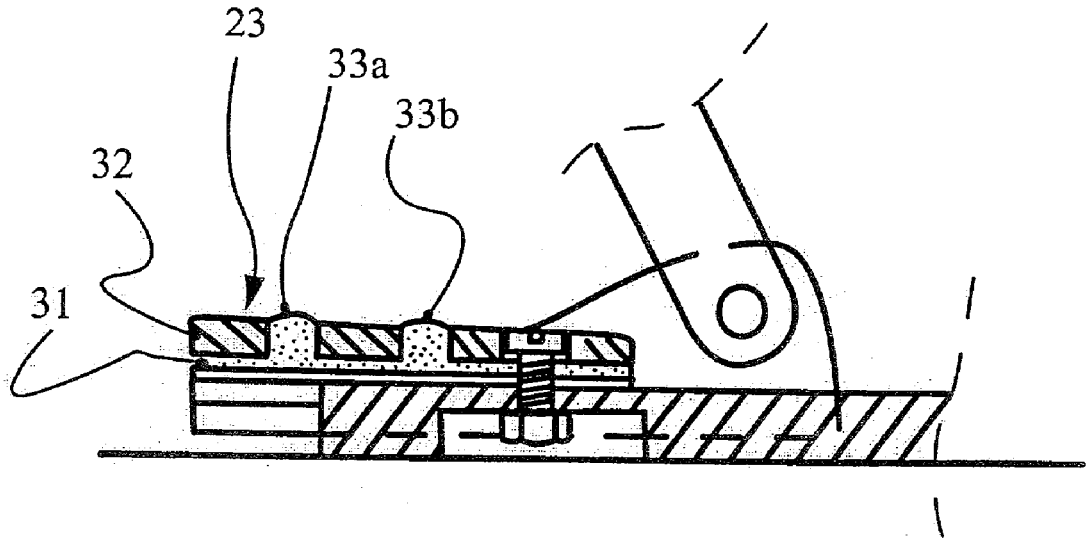

In the embodiment of FIG. 10, the intermediate layer 31 is formed of a deformable or resilient material and has projections 33*a*, 33*b* which extend upward through holes defined in the upper layer 32. This provides a particularly soft support in order to assure the comfort of the snowboarder.

Figure 11:
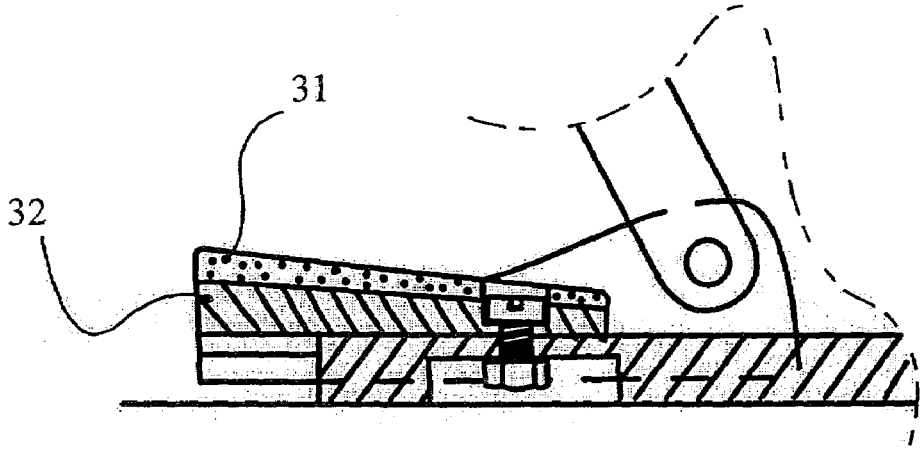

The upper layer of the support can also be of a deformable or resilient material as is illustrated in FIG. 11.

Figure 12:
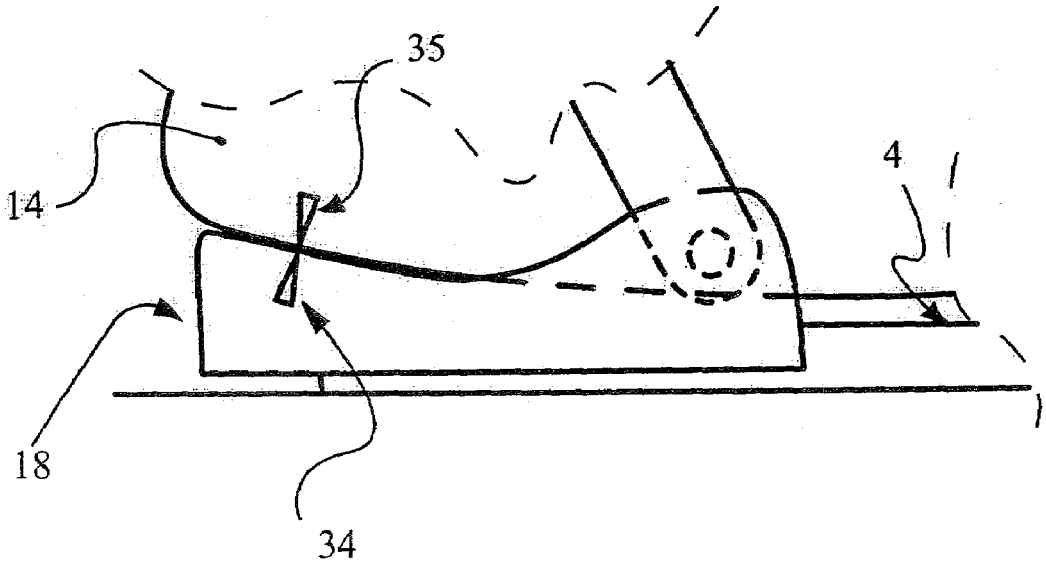

FIG. 12 shows an embodiment which includes a means for indicating that the proper longitudinal position adjustment has been achieved. This is achieved by the front support piece 18 having on its side wall a mark or indicia 34 which is intended to be brought into alignment with a second mark or indicia 35 on the boot. When the support mark 34 and the second mark 35 have been brought into alignment, as shown in the illustration, then the proper adjustment of the front support has been achieved.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A binding assembly for a snowboard comprising:

a boot of a fixed length;

a base plate, the base plate defining a longitudinal channel that extends forward and rearward along a front part of the base plate;

a rear support and retaining means mounted fixed relative to the snowboard for fixing a location of the boot; and, a front support and retention assembly slidably mounted on the base plate including:

a front support piece slidably mounted in and longitudinally slidable along the longitudinal channel of the base plate to adjust a location of the front support piece relative to the boot, such that the front support piece can be slid along the base plate without separating the base plate from the snowboard, and a front retaining means connected to the front support piece for adjustably retaining a front of a boot, such that the front support piece and the retaining means move together on the base plate such that a length between the front support piece and the rear support and retaining means is adjustable and the location of the front support piece relative to the boot is adjustable to adapt to snow and bill conditions.

2. The binding assembly according to claim 1 wherein the rear support and retaining means is pivotally mounted to the base plate and includes:

a rear support piece; and a rear retaining means for retaining the boot at a level of a heel of the foot.

3. The binding assembly according to claim 1 wherein the base plate extends horizontally from a front end to a rear end, a front part of the plate carrying the front support and retention assembly and a rear part of the plate carrying the rear support and retaining means.

4. The binding assembly according to claim 1 wherein the front support piece at least one of is padded and has a resilient layer.

5. The binding assembly according to claim 1 wherein the front support piece has a resilient layer.

6. The binding assembly according to claim 1 further including:

an indicia on the front support piece and an indicia on a boot.

7. The binding assembly according to claim 1 wherein the front retaining means includes:

a semi-rigid front strap which extends over a toe of die boot; and, a means for adjusting the strap.

8. The binding assembly according to claim 2 wherein the base plate is fixedly mounted to the snowboard by a central piece which is disposed in a central part of the base plate, the central piece being circular and permitting the user to adjust a rotational orientation of the base plate relative to a longitudinal plane of symmetry of the snowboard.

9. The binding assembly according to claim 3 wherein the base plate is fixedly mounted to the snowboard by a central piece which is disposed in a central part of the base plate, the central piece being circular and permitting the user to adjust a rotational orientation of the base plate relative to a longitudinal plane of symmetry of the snowboard.

10. The binding assembly according to claim 7 wherein the front support piece includes:

a transverse plate whose side edges are extended by two lateral front walls which extend upward, each of the lateral front walls being configured to engage a side of a toe of the boot, ends of the front strap being mounted to the lateral front walls.

11. The binding assembly according to claim 10 wherein the ends of the front strap are pivotally mounted by front pivots to the front side walls for rotation about a transverse pivot axis defined by the two front pivots.

12. The binding assembly according to claim 11 wherein a support zone defined by a support surface of the front support piece is disposed forward of a transverse vertical plane passing through the transverse pivot axis.

13. The binding assembly according to claim 12 wherein the support surface is disposed under a horizontal plane passing through the transverse pivot axis.

14. The binding assembly according to claim 12 wherein the front support surface slopes longitudinally.

15. A binding for holding a boot on a snowboard, the binding comprising:

a base plate configured to be mounted on the snowboard, the base plate defining a longitudinal channel;

a rear support member mounted to the base plate for retaining a heel of the boot in a fixed position relative to the snowboard;

a front support piece slidably mounted to the base plate channel such that the front support piece is longitudinally adjustable without detaching the base plate from the snowboard to adjust a length between the rear support member and the front support piece to accommodate custom placement of the front support piece relative to the boot;

a front support strap mounted to the front support piece to move longitudinally therewith and being adjustable to accommodate boots of different height; and a rear strap for retaining the heel of the boot on the rear support piece.

16. A binding for holding a boot on a snowboard, the binding comprising:

a base member having a longitudinal channel;

a rear support piece mounted to the base member to fix a position of a heel of a given boot on the base member;

a front support piece movably mounted in the base member longitudinal channel and slidably positionable along the channel without detaching the front support base from the base member;

a front strap for retaining a toe of the boot on the front support piece, the front strap being pivotally mounted to the front support piece such that the front support piece and the front strap are moved longitudinally as a unit to adjust a distance of the front support piece and strap from the rear support piece to enable a skier to customize a relative position of the front support piece and strap relative to a toe portion of the given boot to adapt for skiing style and conditions.

17. The binding according to claim 16 wherein the front support piece includes a front support surface that supports an underside of the boot, the front support surface being inclined such that longitudinally adjusting the front support piece adjusts support of a front of the boot to adapt to snow and bill conditions.

* * * * *